US009550603B2

(12) United States Patent
Glass et al.

(10) Patent No.: US 9,550,603 B2
(45) Date of Patent: Jan. 24, 2017

(54) CONTAINER WITH ARTICULATING CLOSURE

(71) Applicant: Gift Card Impressions, LLC, Kansas City, MO (US)

(72) Inventors: Brett R. Glass, Kansas City, MO (US); Nicole E. Glass, Kansas City, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 304 days.

(21) Appl. No.: 14/144,221

(22) Filed: Dec. 30, 2013

(65) Prior Publication Data

US 2014/0183252 A1 Jul. 3, 2014

Related U.S. Application Data

(60) Provisional application No. 61/747,332, filed on Dec. 30, 2012.

(51) Int. Cl.

| | |
|---|---|
| ***B65D 73/00*** | (2006.01) |
| ***B65D 5/02*** | (2006.01) |
| ***B65D 5/355*** | (2006.01) |
| ***B65D 5/10*** | (2006.01) |
| ***B65D 81/36*** | (2006.01) |
| ***B42D 15/04*** | (2006.01) |
| *B65D 5/42* | (2006.01) |

(52) U.S. Cl.

CPC ..... *B65D 5/02* (2013.01); *B42D 15/045* (2013.01); *B65D 5/0005* (2013.01); *B65D 5/029* (2013.01); *B65D 5/106* (2013.01); *B65D 5/4254* (2013.01); *B65D 81/365* (2013.01); *B65D 5/4208* (2013.01)

(58) Field of Classification Search

CPC ..... B65D 5/02; B65D 5/0005; B65D 5/029; B65D 5/4254; B65D 81/365; B65D 81/368; B65D 33/004

USPC .... 206/232, 457, 459.5, 461, 466, 467, 470, 206/767, 768; 40/312; 229/126, 127, 229/116.1, 116.3; 383/7, 120, 127, 21

See application file for complete search history.

(56) References Cited

U.S. PATENT DOCUMENTS

| | | | | |
|---|---|---|---|---|
| 1,903,461 A * | 4/1933 | Keller | B65D 5/524 | 206/45.28 |
| 2,630,914 A * | 3/1953 | Bekoff | B65D 5/5021 | 206/45.29 |
| 2,748,527 A * | 6/1956 | Seals | A63H 33/00 | 206/216 |
| 3,031,121 A * | 4/1962 | Chase | A45C 7/0059 | 220/902 |
| 5,042,684 A * | 8/1991 | West | B65D 5/563 | 206/386 |

(Continued)

FOREIGN PATENT DOCUMENTS

WO 2014/106205 A1 7/2014

OTHER PUBLICATIONS

International Search Report and Written Opinion from related International Application No. PCT/US2013/078357, dated May 2, 2014; 8 pgs.

*Primary Examiner* — Luan K Bui
(74) *Attorney, Agent, or Firm* — Polsinelli PC

(57) ABSTRACT

A container for receiving a gift, having an articulating closure feature such that arms extending from the flap mimic a waving or hugging motion of a character or other design depicted on the character. The container includes pleated sides to accommodate different size gifts and may further include a closing tab to securely close the container and a handle for carrying the container.

12 Claims, 6 Drawing Sheets

(56) References Cited

U.S. PATENT DOCUMENTS

| | | | | |
|---|---|---|---|---|
| 5,165,800 | A | 11/1992 | Downey | |
| 5,613,312 | A * | 3/1997 | Crowell | A45C 13/08 206/457 |
| 5,682,999 | A * | 11/1997 | Larson | A63H 3/18 206/768 |
| 7,308,741 | B1 | 12/2007 | Rydberg et al. | |
| 8,696,203 | B2 * | 4/2014 | Rednour | A63H 3/50 206/458 |
| 2004/0001654 | A1 * | 1/2004 | Kondo | B65D 33/004 383/120 |
| 2005/0252810 | A1 * | 11/2005 | Zind | B65D 73/0007 206/457 |
| 2008/0037907 | A1 | 2/2008 | Suskind | |
| 2012/0205281 | A1 | 8/2012 | Glass et al. | |

* cited by examiner

CONTAINER WITH ARTICULATING CLOSURE

RELATED APPLICATIONS

This application claims priority to U.S. Provisional Patent Application No. 61/747,332, filed Dec. 30, 2012, and entitled "Container with Articulating Closure," the entire contents of which are incorporated herein by reference.

FIELD

The present disclosure relates generally to gift holders and gift bags. In particular, this disclosure relates to a container for holding gift items that includes a closure mechanism having a plurality of articulated parts bearing indicia or graphics to mimic motion when opening and closing the container.

BACKGROUND

Existing containers that incorporate motion or similar features typically have flaps that are engaged along a container wall and pivot along an arc substantially parallel with a major axis of the container. These containers, however, may not realistically mimic the motion of a character depicted thereon nor securely close the container.

SUMMARY

The present disclosure relates to containers having an articulating closure mechanism such that extensions from a flap of the container move when the container is opened and closed to mimic a moving character.

In one embodiment, a container with articulating closure includes a main body further including a plurality of sides and a closed bottom portion. The plurality of sides define a chamber having an open end opposite the closed bottom portion. The container also includes a closure flap engaged to an upper margin of the main body. The closure flap includes a central panel engaged to a central portion of the upper margin. The closure flap also includes a first articulating side panel engaged to a first side portion of the upper margin and a second articulating side panel engaged to a second side portion of the upper margin. When pivoting the central panel about the upper margin of the main body, the first articulating side panel pivots about the first side portion of the upper margin and the second articulating side panels pivots about the second side portion of the upper margin.

Another embodiment of a container in accordance with this disclosure may include a container with an articulated closure, such as a flap having multiple articulated panels, extending from a main body. The main body has a longitudinal axis extending there through from a bottom end to an upper end. The sides and bottom end of the main body are typically substantially closed and the upper end is typically substantially open. The sides are connected to one another around the outer margins of the main body and are transversely spaced apart from the longitudinal axis. The sides are typically generally parallel to the longitudinal axis when the main body is completely open. The sides terminate at their lower margins at the closed bottom end and terminate at their upper margins at the open upper end. Two opposing sides are typically creased or pleated to allow these sides to fold inward to collapse the main body to a folded position.

At the upper end of the main body, a flap extends from the upper margin of one of the sides, typically a non-pleated or non-creased side and typically a back side. Although the description herein references a flap extending from the back side and passing over the open, upper end to engage a front side, it should be appreciated the front and back are merely relative to one another and in certain embodiments the flap could be described as extending from the front side to engage the back side or from one side to another. The flap includes a plurality of articulated panels. The articulated panels include a central or major panel extending from a central portion of the upper margin of the back side. A left or first minor panel extends from a left portion of the upper margin of the back side, proximate the left margin of the central panel. A right or second minor panel extends from a right portion of the upper margin of the back side, proximate the right margin of the central panel. The central panel attaches to the left panel along one or more left folds, and the central panel attaches to the right panel along one or more right folds, whereby when the central panel is raised or lowered the left panel and the right panel are concomitantly raised or lowered by the action of the central panel.

One embodiment of a container having an articulated closure includes a main body having a longitudinal axis and substantially closed transverse sides. The sides terminate at lower margins thereof at a substantially closed bottom end and terminate at upper margins thereof at an open upper end. The sides of the main body include a first side, a second side adjoining the first side and adjoining a third side, the third side adjoining the second side and adjoining a fourth side, the fourth side adjoining the third side and the first side. A flap extends from the upper margin of the third side at the upper end. The flap includes a plurality of articulated panels, the articulated panels including a major panel extending from a center or central portion of the upper margin of the third side. A first minor panel extends from a first portion of the upper margin of the third side, the first portion being proximate and adjoining the central portion. The first portion of the upper margin extends at a downward angle from the central portion until it reaches the fourth side. A second minor panel extends from a second portion of the upper margin of the third side, the second portion also being proximate and adjoining the central portion. The second portion of the upper margin extends at a downward angle from the central portion until it reaches the second side.

A first articulating panel is interposed between the first minor panel and the major panel. The first articulating panel is in a hinged or pivotable engagement with the first minor panel along one side thereof and is in a hinged engagement with the major panel along another side thereof. A second articulating panel is interposed between the second minor panel and the major panel. The second articulating panel is in a hinged or pivotable engagement with the second minor panel along one side thereof and is in a hinged engagement with the major panel along another side thereof.

In use, the major panel pivots about the central portion and along a major arc substantially coplanar with the longitudinal axis. The minor panels pivot about the first portion and the second portion and along minor arcs that diverge from the major arc so that the first minor panel and the second minor panel pivot from inwardly directed or disposed closed positions to outwardly directed or disposed open positions when the major panel is pivoted upward to open the flap. Conversely, the first minor panel and the second minor panel pivot from outwardly directed or disposed open positions to inwardly directed or disposed closed positions when the major panel is pivoted downward toward the first side to close the flap.

Other advantages of the container will become apparent from the following description taken in connection with the accompanying drawings, wherein is set forth by way of illustration and example an embodiment of the container of the present disclosure.

DETAILED DESCRIPTION

The present disclosure generally relates to a container, such as but limited to a gift bag, that can receive and hold a gift card or other gift. In one aspect, the container includes a closure flap with articulated side flaps and is covered with indicia, graphics, or pictures to mimic the appearance of a person, animal, or any other object. In other aspects, any other indicia or design may be used. When opening and closing the container, the articulated side flaps move away from and towards the main body of the container, respectively, such that the character depicted by the indicia or graphics appears to embrace or alternately reveal the container.

In various aspects, the container is formed from a contiguous planar materiel that has one or more layers. The planar material may be composed of one or more various types of paper, cardboard, card stock, plastics, or other resilient materials. In another aspect, the closure flap and articulating side flaps may be formed separately from the container body and engaged to the container body proximate to an opening in the main body container. The container body may be defined by three or more sides and a bottom portion.

Figure 1A:
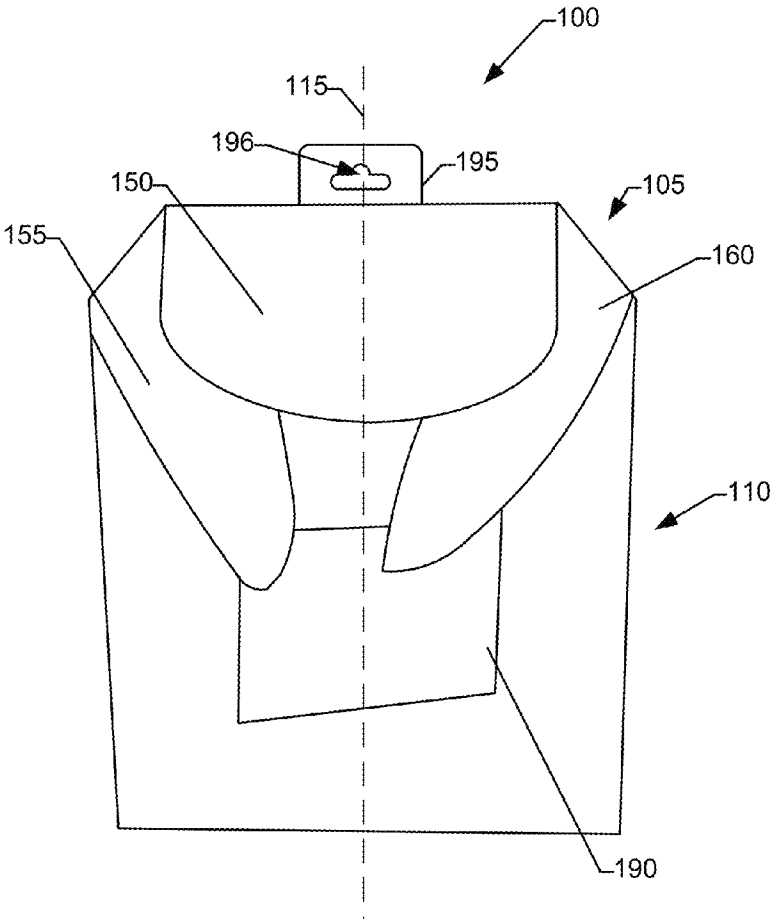
FIGS. 1A-B are an illustration and photograph, respectively, of a front perspective view of a container with the flap in a substantially closed configuration, according to one embodiment.
Figure 1B:
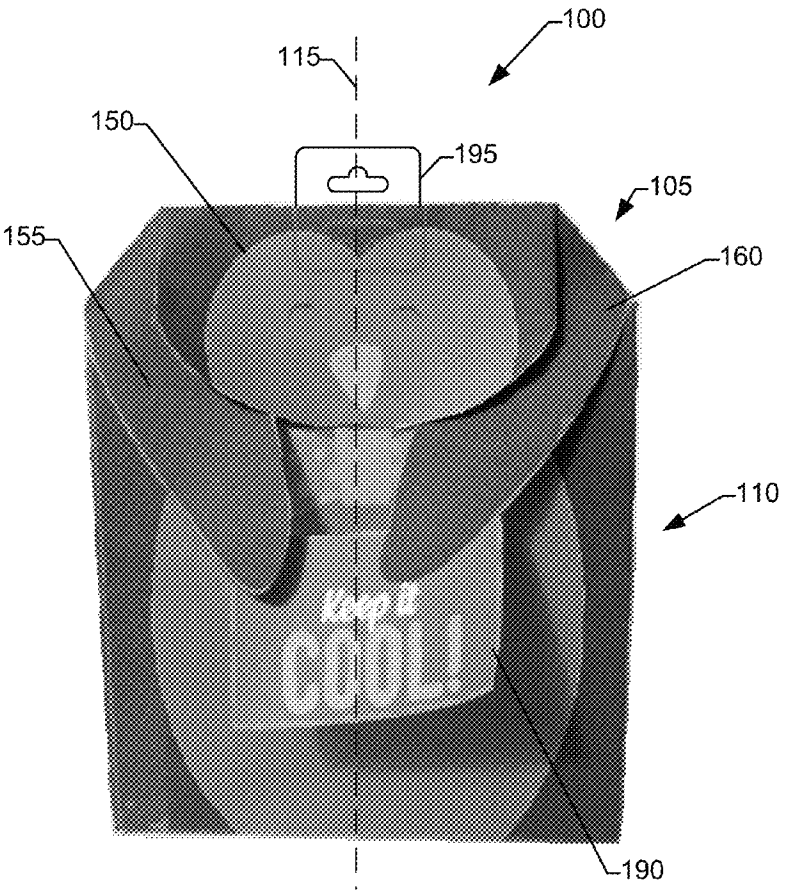
Figure 2B:
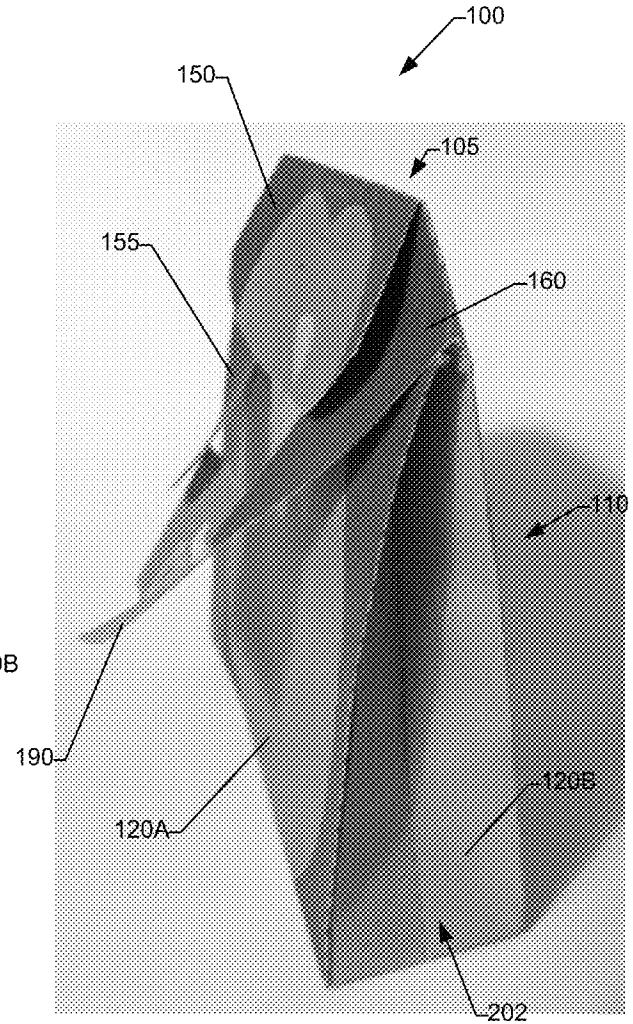
FIGS. 2A-B are an illustration and photograph, respectively, of a front and right side perspective view of the container with the flap in a substantially closed configuration according to one embodiment.
Figure 2A:
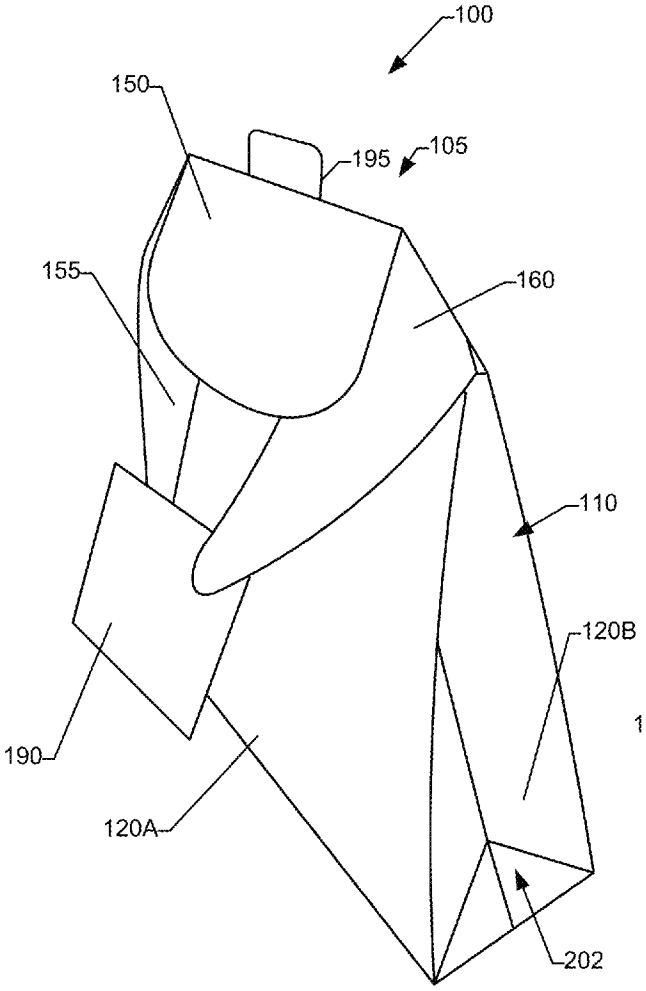
Figure 3B:
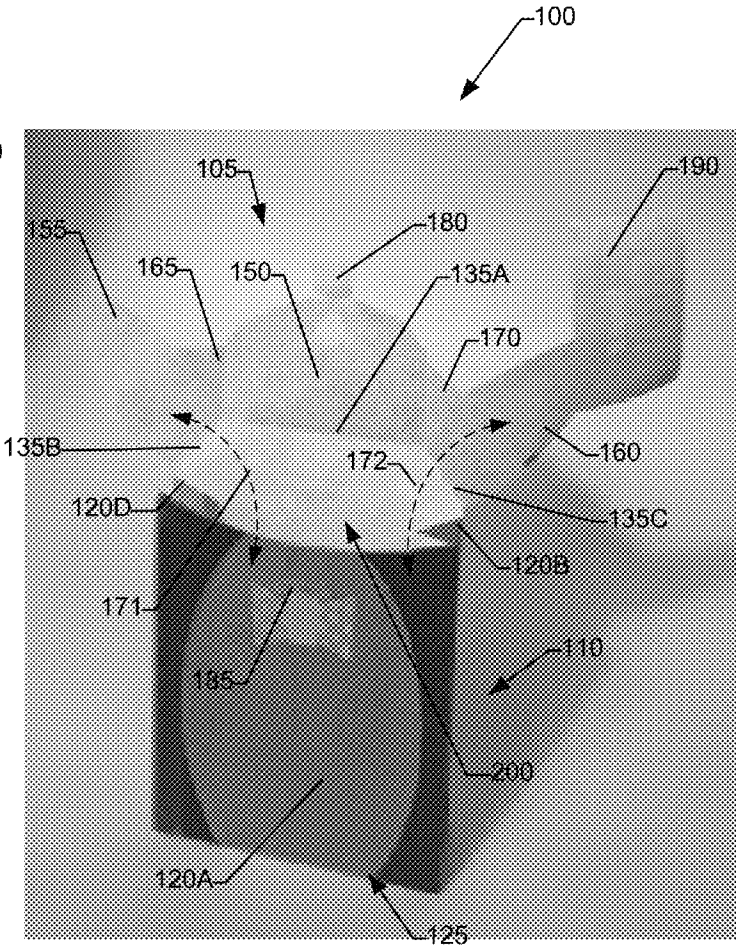
FIGS. 3A-B are an illustration and photograph, respectively, of a front perspective view of a container with the flap in a substantially open configuration according to one embodiment.
Figure 3A:
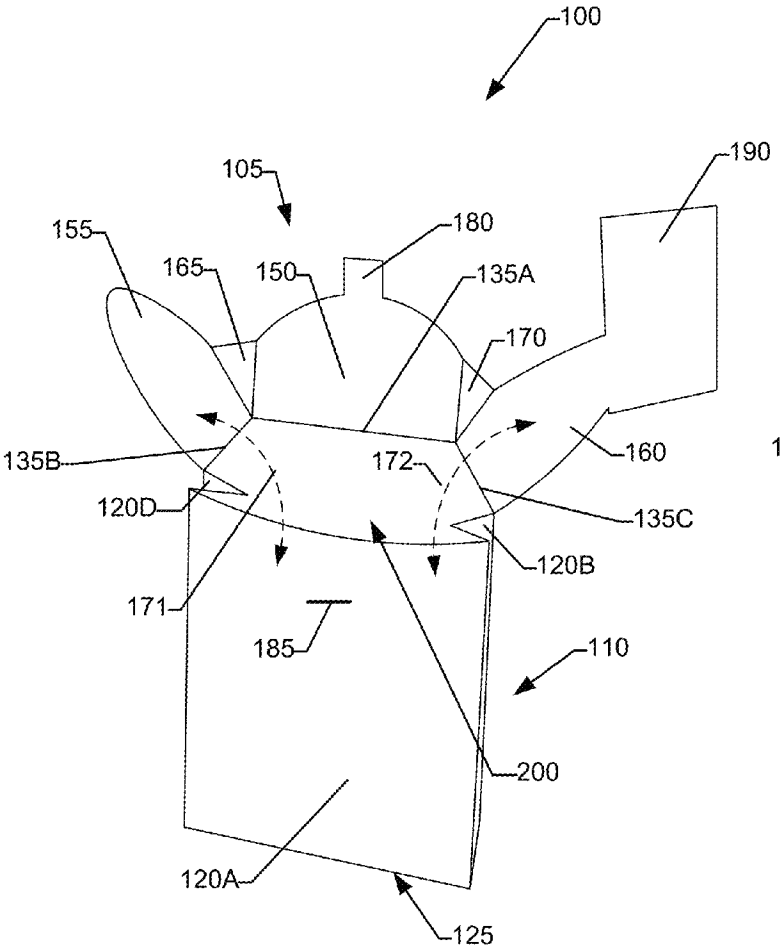
Figure 4B:
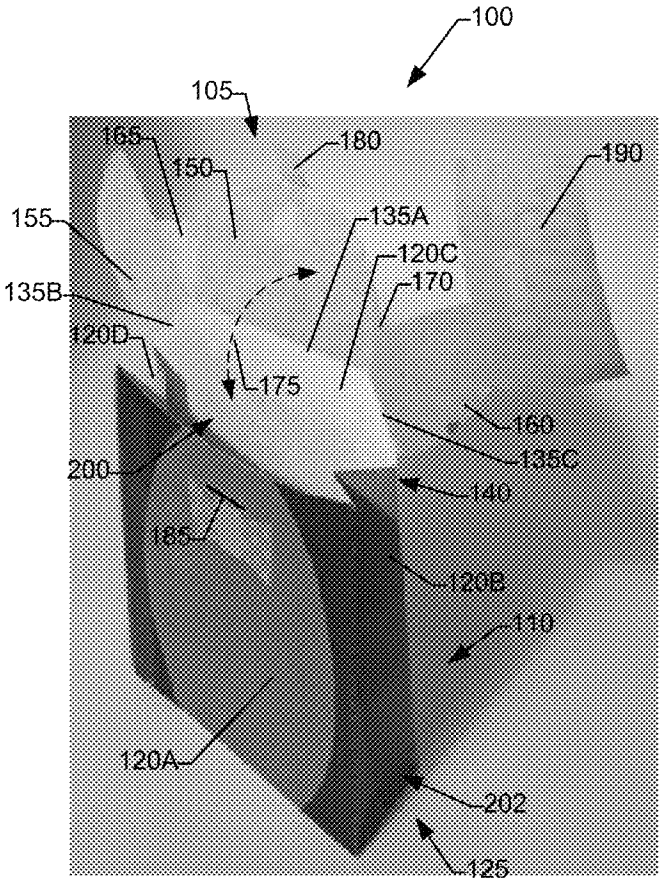
FIGS. 4A-B are an illustration and photograph, respectively, of a front and right side perspective view of the container with the flap in a substantially open configuration according to one embodiment.
Figure 4A:
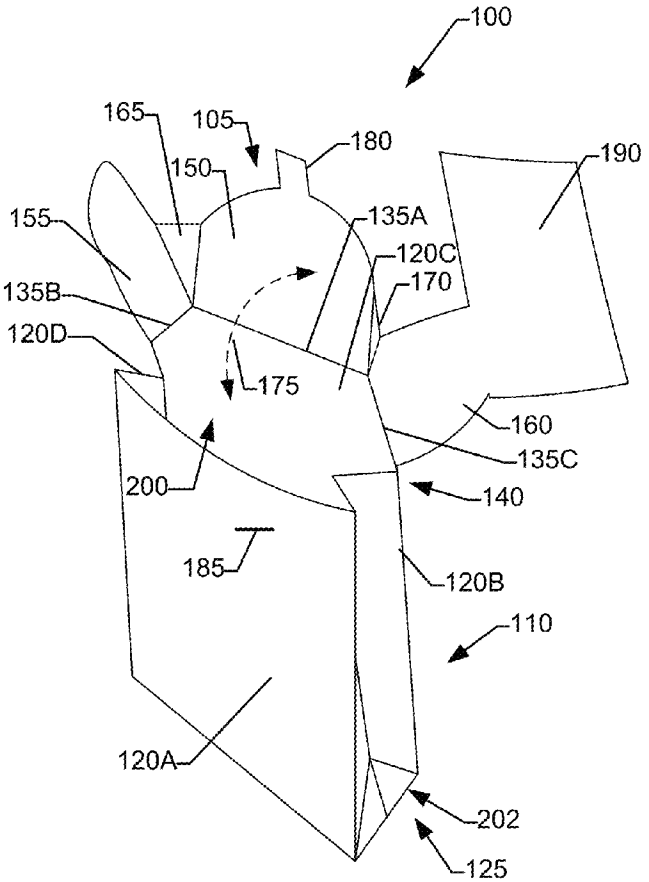

FIGS. 1A-4B depict an embodiment of a container 100 having an articulated closure. In particular, FIGS. 1A and 2A are drawings of the container 100 in a closed configuration while FIGS. 3A and 4A depict the container in an open configuration. Similarly, FIGS. 1B, 2B, 3B, and 4B are photographs of an embodiment the container 100 that correspond with the respective drawings in FIGS. 1A, 2A, 3A, and 4A. As shown in FIGS. 1B, 2B, 3B, and 4B, the container 100 may include indicia or graphics to represent a character or caricature, such as a penguin. In other embodiments, other indicia may be used to depict other animals, people, or any other objects.

As shown, the container 100 includes a multi-panel closure flap 105 and main body 110 having a longitudinal axis 115 and sides 120A-D. The sides 120A-D of the main body 110 include a first side 120A, a second side 120B adjoining the first side 120A and adjoining a third side 120C. The third side 120C adjoins the second side 120B and adjoins a fourth side 120D, while the fourth side 120D adjoins the third side 120C and the first side 120A. The sides 120A-D each terminate at lower margins or borders 125 thereof at a substantially closed bottom portion 130 and terminate at upper margins or borders 135A-C thereof to define an open upper end 140. As shown in FIGS. 2A-4B, 7, 9, and 10, the second side 120B and the fourth side 120D include one or more fold lines 202 to form pleats therein. The pleated second side 120B and fourth side 120D allow the container 100 to receive gifts of various sizes. The sides 120A-D define an interior chamber 200 to receive a gift or gift card placed within the container.

Figure 5:
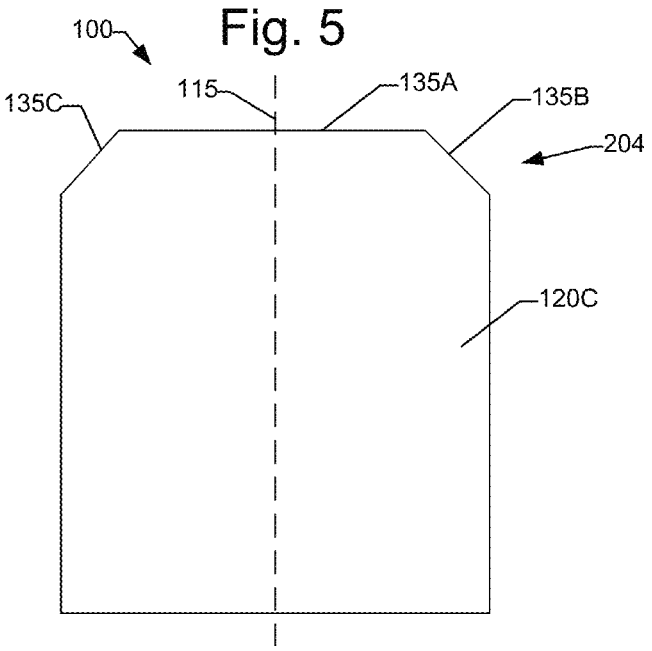
FIG. 5 is a back elevation view of the container according to one embodiment.

In one embodiment, the sides 120A, 120B, and 120D are generally rectangular, while the third side 120C has a six-sided configuration. In particular, as shown in FIG. 5, the third side 120C has a length along the longitudinal axis 115 that is greater than the sides 120A, 120B, and 120D. As shown, the upper portion 204 of the third side 120C has a generally trapezoidal configuration with a central edge or margin 135A that is substantially perpendicular to the longitudinal axis 115. The upper portion 204 also includes two angled edges or margins 135B-C The closure flap 105 is engaged to and extends from the upper margin or borders 135A-C at the upper portion 204 of the third side 120C. The flap 105 includes a plurality of articulated panels 150-170, the articulated panels including a central or major panel 150 engaged to and extending from a central margin 135A of the upper portion 204 of the third side 120C. The closure flap also includes a first minor panel 155 engaged to and extending from a first angled margin 135B. The first margin 135B is proximate to and adjoins the central margin 135A. The angled first margin 135B extends downward from the central margin 135A until it reaches the fourth side 120D. A second minor panel 160 extends from a second angled margin 135C of the upper portion 204. The second angled margin 135C also being proximate and adjoining the central margin 135A. The second angled margin 135C extends downward from the central margin 135A until it reaches the second side 120B.

A first articulation panel 165 is interposed between the first minor panel 155 and the major panel 150. The first articulation panel 165 is in a hinged or pivotable engagement with the first minor panel 155 along one side thereof and is hingedly engaged with the major panel 150 along another side thereof. A second articulation panel 170 is interposed between the second minor panel 160 and the major panel 150. The second articulation panel 170 is in a hinged or pivotable engagement with the second minor panel 160 along one side thereof and is in a hinged engagement with the major panel 150, along another side of the major panel.

When transitioning between the closed configuration of FIGS. 1A-2B and open configuration of FIG. 3A-4B, the major panel 150 pivots about the central margin 135A along a major arc 175 that is substantially coplanar with the longitudinal axis 115. As the major panel pivots about the central border 135A, the minor panels 155 and 160 pivot about the first margin 135B and the second margin 135C, respectively, along a corresponding first minor arc 171 and a second minor arc 172, respectively. The minor arc 171 and 172 are angled away from or diverge from the major arc 175 so that the first minor panel 155 and the second minor panel 160 each pivot from an inwardly-directed orientation in the closed configuration to an outwardly-directed orientation in the closed configuration when the major panel 150 is pivoted upward to open the closure flap 105.

Conversely, the first minor panel 155 and the second minor panel 160 pivot from outwardly-directed or disposed open orientations to inwardly-directed or disposed closed orientations when the major panel 150 of the closure flap 105 is pivoted towards the first side 120A to close container 100.

As shown in FIGS. 3A-4B, a tab 180 extends from the major panel 150. The tab 180 is received at a slot 185 in the front or first side 120A to securely retain the flap 105 when in the closed configuration, as shown in FIGS. 1A-2B. In another embodiment, the tab 180 may be removably engaged to the front side 120A by a removable adhesive or a hook and loop closure mechanism. Other closing and retaining mechanism may also be used.

Figure 7:
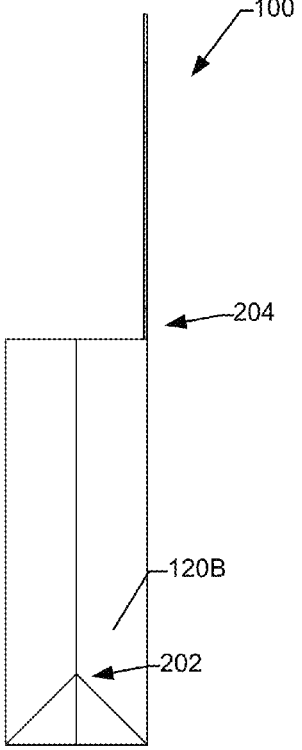
FIG. 7 is a side elevation view of the container according to one embodiment.
Figure 6:
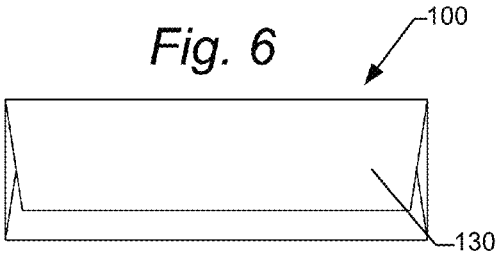
FIG. 6 is a bottom plan view of the main body of the container according to one embodiment.
Figure 8:
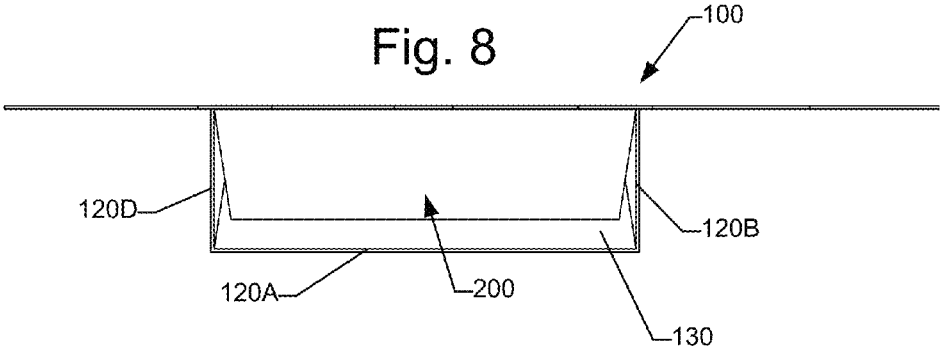
FIG. 8 is a top plan view of the container according to one embodiment according to one embodiment.

FIGS. 5-8 are elevation and plan views of an embodiment of the container 100 in various configurations. In particular, FIG. 5 is an elevation view of the back side of the container 100 in a closed configuration, while FIG. 6 is a bottom plan view of the main body 110 of the container in the closed configuration. FIG. 7 is a side elevation view of the container 100 in an open configuration, while FIG. 8 is a top plan view of the container in the open configuration.

Figure 9:
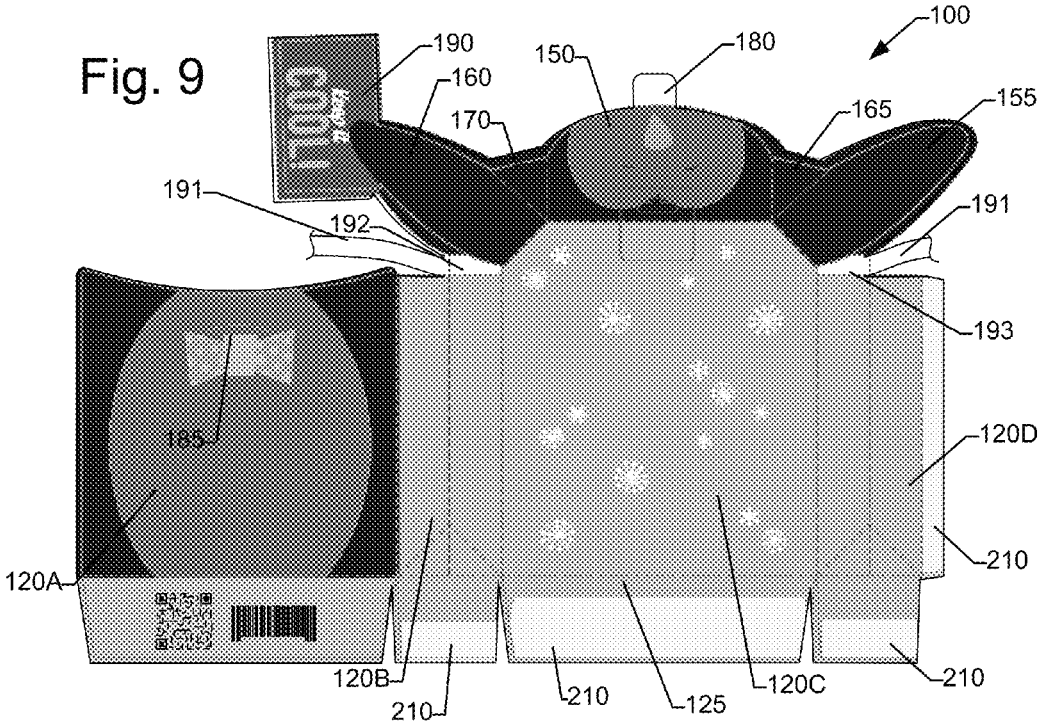
FIG. 9 is a plan view of the outer surfaces of an unassembled container according to one embodiment.
Figure 10:
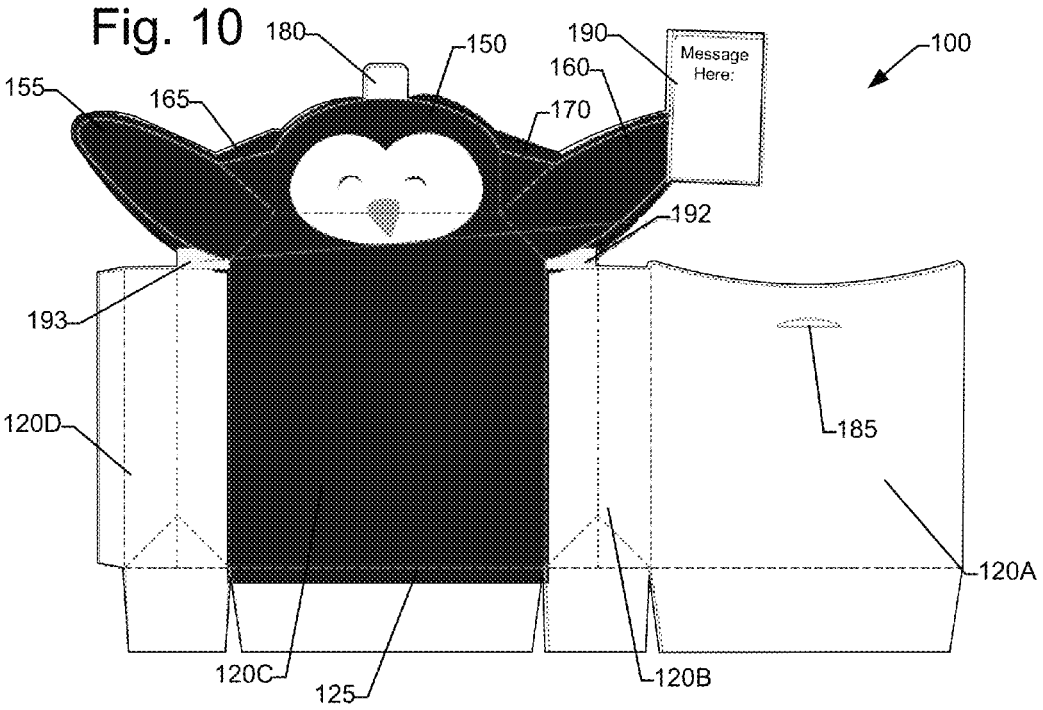
FIG. 10 is a plan view of the inner surfaces of an unassembled container according to one embodiment.

As previously described, the container 100 may be formed from one or more planar materials. FIG. 9 is a plan view of the outer surfaces of an unassembled container 100, while FIG. 10 is a plan view of the inner surfaces of an unassembled container 100. As shown in FIGS. 9-10, the planar material includes one or more folds or score lines that define the various sides 120A-D, margins, 135 A-C, and flaps 105 and 150-170. During assembly, the planar material may be folded to form the container 100 as shown in FIGS. 1A-8. An adhesive or other suitable fastener may be applied to tab portions 210 to join the sides 120A to 120D and to form the bottom portion 130.

In one embodiment, the second minor panel 160 may include a message card 190 to bear a message to a gift recipient. Additionally, an elongated handle 191 may be included to provide a handle for carrying the container. In one aspect, the handle 191 is an elongated piece of paper, cardboard, plastic, fabric, ribbon, or any other suitable material that is attached via an adhesive or any other suitable attachment method at a first end to a first handle tab 192 and at a second end to a second handle tab 193. When assembled, the handle 191 passes over the closure flap 105 to suspend main body 110 from the handle carrying the container 100. In another aspect, a hanger tab 195 may be removably attached to the back of the third side 120C. The hanger tab 195 includes a hole 196 (such as a sombrero-cut hole) for hanging the container 100 upon the peg of a display rack (not shown).

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

Those skilled in the art will appreciate that variations from the specific embodiments disclosed above are contemplated by the disclosure. The following disclosure should not be restricted to the above embodiments, but should be measured by the following claims.

What is claimed is:

1. A container with articulating closure comprising:

a main body including a plurality of sides and a closed bottom portion, wherein the plurality of sides define a chamber having an open end opposite the closed bottom portion;

a closure flap engaged to an upper margin of the main body, wherein the closure flap includes a central panel engaged to a central portion of the upper margin, a first articulating side panel engaged to a first side portion of the upper margin, and a second articulating side panel engaged to a second side portion of the upper margin;

a first minor panel extending from a left portion of the upper margin of at least one side of the plurality of sides and proximate to the left margin of the central panel, and a second minor panel extending from a right portion of the upper margin of at least one side of the plurality of sides and proximate to the right margin of the central panel;

wherein in a closed disposition, one or more of the minor panels extend beyond the central panel;

wherein pivoting the central panel about the upper margin of the main body causes the first articulating side panel to pivot about the first side portion of the upper margin and the second articulating side panel to pivot about the second side portion of the upper margin.

2. The container of claim 1 wherein the upper margin of the main body is a border for a back side of the plurality of sides of the main body and wherein the back side has a length along a longitudinal axis of the container greater than that of the other sides of the plurality of sides.

3. The container of claim 1 wherein the first articulating side panel is engaged to the central panel via a first articulation panel and the second articulating side panel is engaged to the central panel via a second articulation panel.

4. The container of claim 1 further comprising a message panel engaged to at least one of the first articulating side panel and the second articulating side panel.

5. The container of claim 1 further comprising a handle; wherein a first end of the handle is engaged to a first handle tab and a second end of the handle is engaged to a second handle tab, such that the main body is suspended from the handle when carried.

6. The container of claim 1 wherein a first and second side panel of the plurality of sides comprises pleats.

7. The container of claim 1 further comprising:

a closure tab extending from the closure flap; and a slot defined in a front side of the plurality of sides to receive the closure tab when the container is in a closed configuration.

8. The container of claim 1 further comprising a removable hanger tab defining a hole to receive a peg from a display stand.

9. The container of claim 1 further comprising indicia resembling at least one of a person, animal, or other object having arms.

10. A container with an articulating closure comprising:

a main body having an open configuration and a closed configuration, the main body further including:

a bottom end;

an upper end;

a plurality of sides, wherein the plurality of sides and the bottom end are substantially closed, while the upper end is typically substantially open; and the plurality of sides engaged to one another around outer margins of the main body and transversely spaced apart from a longitudinal axis extending from the bottom end to the upper end, each of the plurality of sides is generally parallel to the longitudinal axis when the main body is in the open configuration and where each of the sides terminate at their lower margins at the closed bottom end and terminate at their upper margins at the open upper end; and a closure flap having multiple articulated panels, extending from the main body, where the closure flap extends from the upper margin of at least one side of the plurality of sides, the closure flap further comprising:

a plurality of articulated panels including a central panel, a first minor panel extending from a left portion of the upper margin of the at least one side of the plurality of sides and proximate to a left margin of the central panel, and a second minor panel extending from a right portion of the upper margin of at least one side of the plurality of sides and proximate to a right margin of the central panel;

wherein, in a closed disposition, one or more minor panels extend beyond the central panel;

wherein the central panel is engaged to the first minor panel along one or more left folds and engaged to the second minor panel along one or more right folds; and whereby, when the central panel is raised or lowered, the first minor panel and the second minor panel are concomitantly raised or lowered by the action of the central panel.

11. The container of claim 10 wherein the one or more of the plurity of sides is pleated and the closure flap extends from the upper margin of at least one non-pleated side.

12. The container of claim 10 further comprising:

a first articulation panel interposed between the first minor panel and the central panel, wherein the first articulating panel is hingedly engaged with the first minor panel along one side thereof and is hingedly engaged with the central panel along another side thereof; and a second articulation panel is interposed between the second minor panel and the central panel, wherein the second articulating panel is hingedly engaged with the second minor panel along one side thereof and is hingedly engaged with the central panel along another side thereof.

* * * * *